US009723904B1

(12) United States Patent
Taylor

(10) Patent No.: US 9,723,904 B1
(45) Date of Patent: Aug. 8, 2017

(54) JEWELRY STORAGE SYSTEM AND METHOD OF USE

(71) Applicant: Sabra Taylor, Dallas, TX (US)

(72) Inventor: Sabra Taylor, Dallas, TX (US)

( * ) Notice: Subject to any disclaimer, the term of this patent is extended or adjusted under 35 U.S.C. 154(b) by 0 days.

(21) Appl. No.: 15/274,243

(22) Filed: Sep. 23, 2016

Related U.S. Application Data

(60) Provisional application No. 62/232,954, filed on Sep. 25, 2015.

(51) Int. Cl.

| | |
|---|---|
| ***A47F 7/02*** | (2006.01) |
| ***A45C 11/16*** | (2006.01) |
| ***A45C 13/02*** | (2006.01) |
| ***A47B 81/00*** | (2006.01) |
| ***A47B 96/20*** | (2006.01) |

(52) U.S. Cl.
CPC ..... *A45C 11/16* (2013.01); *A45C 13/02* (2013.01); *A47B 81/00* (2013.01); *A47B 96/20* (2013.01); *A45C 2013/026* (2013.01); *A47B 2096/207* (2013.01); *A47F 7/022* (2013.01)

(58) Field of Classification Search
CPC ... A45C 11/16; A45C 13/02; A45C 2013/026; A47B 81/00; A47B 96/20; A47B 2096/207; A47F 7/022
USPC ..... 211/85.2; 206/6.1, 566; 312/209, 321.5
See application file for complete search history.

(56) References Cited

U.S. PATENT DOCUMENTS

| | | | | | |
|---|---|---|---|---|---|
| 949,485 | A * | 2/1910 | Karay | D05B 91/14 | 223/107 |
| 1,456,613 | A * | 5/1923 | Bartels | A47F 7/03 | 206/558 |
| 1,960,073 | A * | 5/1934 | Warner | A45C 11/16 | 206/303 |
| 2,439,664 | A * | 4/1948 | Marchand | A47B 67/02 | 126/194 |
| 2,911,275 | A * | 11/1959 | Wise | A47B 96/00 | 312/242 |
| D186,829 | S * | 12/1959 | Jachetta | D3/270 | |
| 3,321,117 | A * | 5/1967 | Hedin | D05B 91/14 | 206/227 |
| 3,421,634 | A * | 1/1969 | Huth | A47B 81/00 | 206/561 |
| 4,040,202 | A * | 8/1977 | Wille | A01K 97/06 | 43/57.2 |
| 4,324,446 | A * | 4/1982 | LeSage | A45C 11/16 | 206/566 |
| D266,115 | S * | 9/1982 | Glenn, Sr. | D3/295 | |
| 4,420,084 | A * | 12/1983 | Whelan | A47F 7/02 | 206/486 |
| 4,776,650 | A * | 10/1988 | Ferenzi | A47B 67/02 | 211/85.2 |

(Continued)

*Primary Examiner* — Joshua J Michener
*Assistant Examiner* — Devin Barnett
(74) *Attorney, Agent, or Firm* — Eldredge Law Firm; Richard G. Eldredge

(57) ABSTRACT

A jewelry storage system includes a first elongated section, a second elongated section, and a third elongated section. The system further includes a necklace panel, an earring panel, a ring bar, an earring shelf, a cylindrical bracelet bar, a panel, and a locking mechanism having a plurality of slots extending partially through the thickness of the first side of the second elongated section; and a tab rigidly secured to the panel and removably attached to the plurality of slots.

1 Claim, 2 Drawing Sheets

(56) References Cited

U.S. PATENT DOCUMENTS 4,848,585 A * 7/1989 Snyder ..... A45C 11/16 206/315.11
4,923,069 A * 5/1990 Germain ..... A47F 7/02 206/495
4,978,001 A * 12/1990 Nelson ..... A47B 46/00 206/6.1
D317,380 S * 6/1991 Snyder ..... D3/295
5,033,625 A * 7/1991 Campbell ..... A47F 7/02 206/495
5,035,319 A * 7/1991 Kunisch ..... A45C 13/02 206/566
5,050,745 A * 9/1991 Sanders ..... A45C 11/16 206/495
5,067,617 A * 11/1991 Caldwell ..... A47F 7/02 206/495
5,069,332 A * 12/1991 Williams ..... A45C 7/0054 206/495
5,121,833 A * 6/1992 Lindsay ..... A45C 7/0095 206/18
5,141,300 A * 8/1992 Ciesla ..... A47F 7/02 206/566
5,168,986 A * 12/1992 Stenhouse ..... A47F 7/02 206/45.24
D335,768 S * 5/1993 Romo ..... D3/295
D348,155 S * 6/1994 McCreary ..... D3/295
5,363,953 A * 11/1994 Carter ..... A45C 11/16 206/495
D368,583 S * 4/1996 Sharer ..... D3/294
5,511,873 A * 4/1996 Mech ..... A45C 11/16 206/566
D382,731 S * 8/1997 Martin ..... D3/903
D387,920 S * 12/1997 Powell ..... D6/312
5,692,605 A * 12/1997 Lai ..... A45C 13/02 206/566
D393,542 S * 4/1998 Thompson ..... D3/294
5,762,184 A * 6/1998 Greiner ..... A47F 7/02 206/6.1
5,899,343 A * 5/1999 Franklin ..... A47F 7/02 211/85.2
5,931,319 A * 8/1999 Murphy ..... A47F 7/02 211/85.2
6,161,686 A * 12/2000 Simon ..... A45C 11/16 206/6.1
D436,727 S * 1/2001 Hsu ..... D3/294
6,361,130 B1 * 3/2002 Kardy ..... A47B 81/00 211/85.2
6,375,018 B1 * 4/2002 Clement ..... A47F 7/02 211/85.2
6,857,519 B2 * 2/2005 Daetweiler ..... A45C 11/16 206/566
6,884,081 B1 * 4/2005 Ovadia ..... A45C 11/16 206/480
6,926,136 B1 * 8/2005 Lynch-Bass ..... A45C 11/16 206/6.1
6,991,118 B2 * 1/2006 Phillips ..... A45C 11/16 211/49.1
7,008,029 B1 * 3/2006 Aclin ..... A47B 67/02 206/566
D525,030 S * 7/2006 Farmer ..... D3/271.1
7,367,449 B2 * 5/2008 Kaminski ..... A45C 11/16 206/1.5
7,389,868 B2 * 6/2008 Lewand ..... A45C 11/16 206/495
D601,798 S * 10/2009 Hsu ..... D3/295
7,673,744 B1 * 3/2010 Henderson ..... A45C 11/16 206/473
7,806,255 B1 * 10/2010 Staver ..... A45C 11/16 206/6.1
8,070,025 B1 * 12/2011 Nelson ..... A47G 25/14 211/85.2
D667,238 S * 9/2012 Greiner ..... D6/668.2
8,651,291 B1 * 2/2014 Prather ..... A45F 5/00 211/113
D705,582 S * 5/2014 Hayes ..... D6/675.1
8,770,416 B1 * 7/2014 Guida ..... A47F 5/08 211/10
9,131,789 B1 * 9/2015 Williams ..... A47F 5/04
D769,025 S * 10/2016 Eberling ..... D6/569
2003/0062285 A1 * 4/2003 Bleggi ..... A45C 11/16 206/493
2003/0234185 A1 * 12/2003 Flagg ..... A45C 11/16 206/6.1
2005/0011774 A1 * 1/2005 Barker ..... A45C 11/16 206/6.1
2006/0180481 A1 * 8/2006 McGaughey ..... A47F 7/02 206/6.1
2007/0175772 A1 * 8/2007 Cunningham ..... A45C 7/005 206/6.1
2010/0000884 A1 * 1/2010 Harris-Bowman ..... A47F 7/03 206/6.1
2011/0266163 A1 * 11/2011 Mostowy ..... A45C 5/02 206/6.1
2012/0241329 A1 * 9/2012 Gaspari ..... A45C 11/26 206/6.1
2013/0256159 A1 * 10/2013 Walsh ..... A45C 11/16 206/6.1
2014/0263116 A1 * 9/2014 Wojciechowski .... A47F 5/0807 211/85.2
2015/0068993 A1 * 3/2015 Ye ..... A45C 11/16 211/85.2
2015/0257551 A1 * 9/2015 Trainor-Smith ..... A47F 7/02 211/85.2
2015/0313379 A1 * 11/2015 Millen ..... A47F 7/02 211/85.2
2016/0150895 A1 * 6/2016 Conley ..... A47G 25/14 211/85.2
2016/0174675 A1 * 6/2016 Bedman ..... A45C 11/16 206/6.1
2017/0014002 A1 * 1/2017 Frisbie ..... A45C 5/04

* cited by examiner

JEWELRY STORAGE SYSTEM AND METHOD OF USE

BACKGROUND

1. Field of the Invention

The present invention relates generally to storage systems, and more specifically, to a jewelry storage system for organization of jewelry collections.

2. Description of Related Art

Storage systems are well known in the art and are effective means to organize items such as jewelry, accessories, and clothing. For example, FIG. 1 depicts a conventional jewelry storage system 101 having a base 102 in communication with a lid 103 and jewelry 104. During use, the user (not shown) stores jewelry 104 in the base 102.

One of the problems commonly associated with system 101 is its limited organizational features. For example, system 101 does not provide all users with adequate room and/or storage elements appropriate for all types of jewelry such as large or long necklaces. As a result, there is a risk that jewelry can become lost, damaged, or tangled.

Accordingly, although great strides have been made in the area of jewelry storage systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
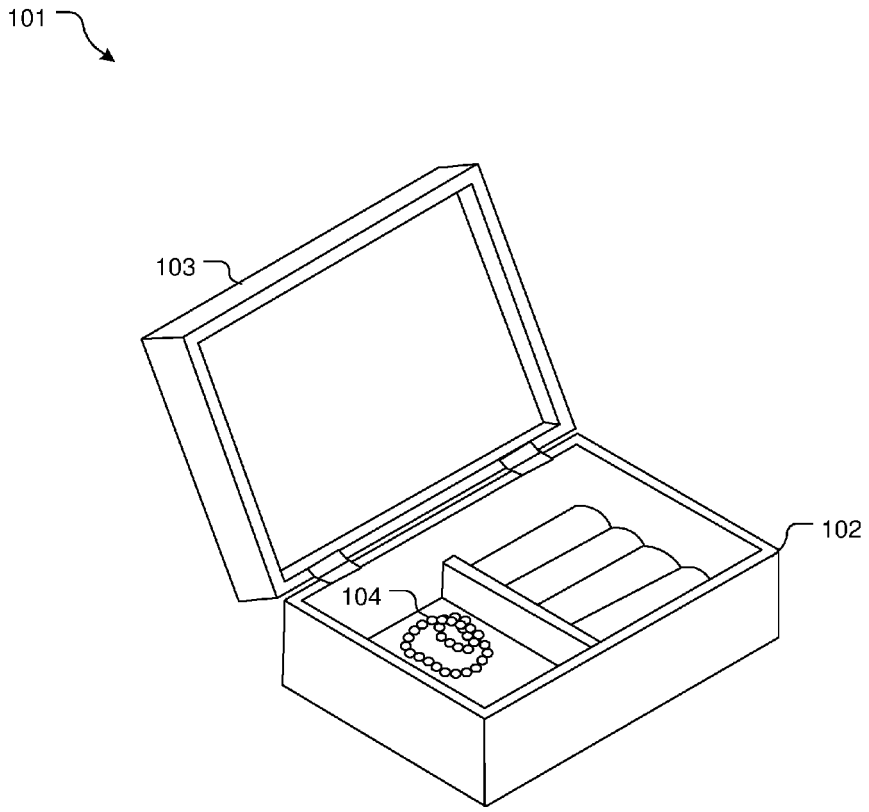
FIG. 1 (Prior Art)
FIG. 1 is an oblique view of a common jewelry storage system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional jewelry storage systems. Specifically, the present invention provides adequate means of organization and storage for most jewelry collections and reduces the risk of jewelry becoming damaged, lost, or tangled. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
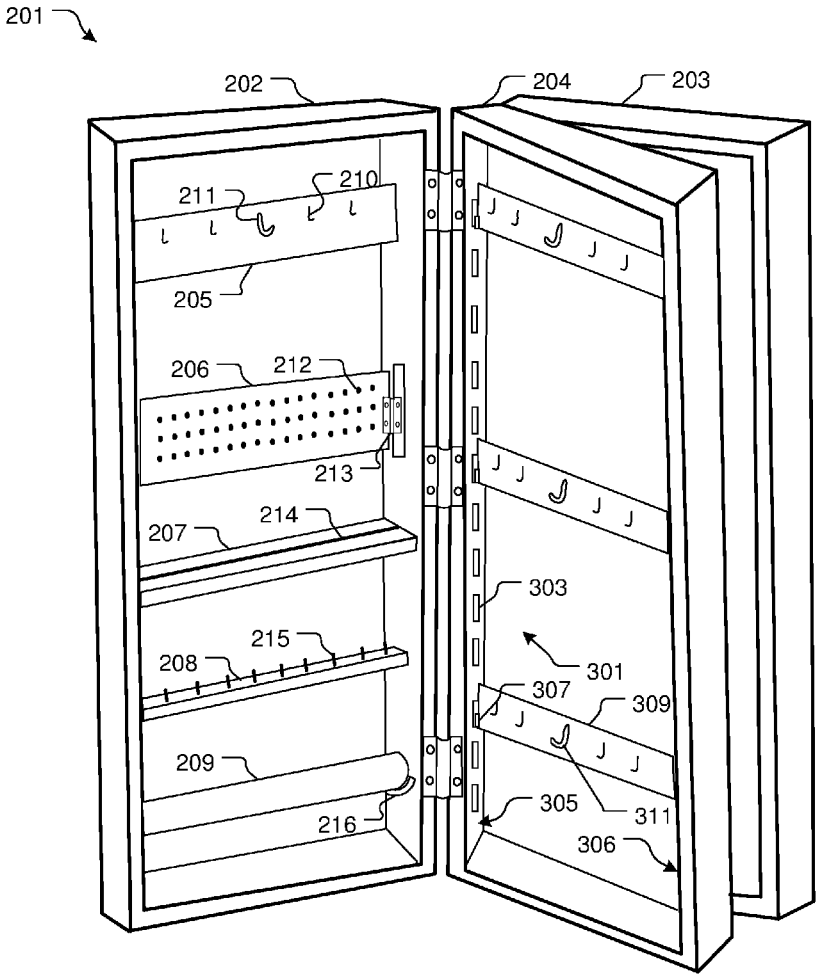
FIG. 2 is a front view of a jewelry storage system in accordance with a preferred embodiment of the present application.

Referring now to the drawings wherein like reference characters identify corresponding or similar elements throughout the several views, FIG. 2 depicts a front view of a jewelry storage system in accordance with a preferred embodiment of the present application. It will be appreciated that system 201 overcomes one or more of the above-listed problems commonly associated with conventional jewelry storage systems.

In the contemplated embodiment, system 201 includes two outside sections 202, 203 in communication with one or more middle sections 204. Each outside section 202, 203 comprises a rectangular, box type structure with one closed side and one open side. The middle section 204 comprises one or more open sides. During use, jewelry is stored in the open sides of the sections 202, 203, 204. Although not shown for each section, the sections include opposing sides that engage with the bars, panels, elements, and the like. For example, section 204 includes a first section 305 and a second opposing side 306 running relatively parallel with each other.

Each section 202, 203, 204 houses one or more various jewelry storage elements 205, 206, 207, 208, 209. Contemplated jewelry storage elements include: a necklace storage panel 205 comprising various sized hooks 210, 211; an earring storage panel 206 comprising holes 212 for stud earrings and a pivot point 213; a ring storage shelf 207 comprising a ring holding groove 214; an earring storage shelf 208 comprising hoop earring protrusions 215 extending from shelf; and a bracelet storage bar 209 secured to a rod socket 216. It will be appreciated that the present and alternative embodiments could include ring bars, bracelet bars, bangle bars, stud panels, earring panels, necklace panels, and the like. It should also be appreciated that the panels and bars are removably attached to the structure, which in turn allows the user to interchange the desired types of panels and bars. One method to achieve this feature is via a locking mechanism 301 configured to engage with the panels and the sides of the sections, as described more fully below.

It should be appreciated that one of the unique features believed characteristic of the present application is the means of adequate organization of jewelry collections due to the various jewelry storage elements. It is understood that the various sized hooks 210, 211 of the necklace storage wall 205 provide a means to store many sized necklaces with reduced risk of tangles and damage to necklaces. In addition, the pivot point 213 of the earring storage wall 206 provides a means to conveniently attach and display stud earrings onto the earring storage wall 206, which is understood to reduce the risk of misplaced stud earrings. Further, the rod socket 216 allows for removal of the bracelet storage rod 209, which enables the securement of one or more bracelets around the bracelet storage rod 209 and reduces the risk of loss or damage to the bracelets.

Alternative embodiments of the present application contemplate incorporating a base structure (not shown) that supports sections 202, 203, 204 and wheels (not shown) in communication with the base structure to facilitate movement of system 201 on a surface. In addition, it is contemplated that sections 202, 203, 204 and the various jewelry storage elements can vary in size, material, number, and placement as manufacturing, aesthetic, or functional considerations require.

One of the unique features believed characteristic of the present invention is the use of removable panels 309 that are adjusted in height via a locking mechanism 301 having a plurality of slots 303 partially extending through the thickness of the side 305 and adapted to engage with a tab 307 on opposing ends of the panel 309. This feature is particularly useful because the user can adjust the height according to the reach capacity and/or size of the jewelry hanging from hook 311 secured to the panel 309. It will be appreciated that all elements could incorporates the features of panel 309 and locking mechanism 301 to adjust for different height and/or jewelry sizes.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A jewelry storage system, consisting of:

a first elongated frame section, a second elongated frame section, and a third elongated frame section; the first, second, and third elongated frame sections each have a first sidewall, a second sidewall, a top wall and a bottom wall; the first elongated frame section further having a front wall so that the first elongated frame section defines a box shape with an open end; and the third elongated frame section further having a rear wall so that the third elongated frame section defines a box shape with an open end;

wherein the first elongated frame section is pivotally attached to the second elongated frame section by a first hinge and the second elongated frame section is pivotally attached to the third elongated frame section by a second hinge;

wherein the first elongated frame section and the second elongated frame section form a first cavity for jewelry storage and the third elongated frame section and the second elongated frame section form a second cavity for jewelry storage;

a necklace panel removably secured to the first sidewall and the second sidewall of the first elongated frame section, the necklace panel having a plurality of hooks configured to removably engage with necklaces;

an earring panel removably secured to the first sidewall and the second sidewall of the first elongated frame section, the earring panel having a plurality of holes configured to receive earning studs;

a pivot joint secured to the second sidewall of the first elongated frame section and secured to the earring panel, the pivot joint being configured to allow pivoting movement of the earring panel relative to the second sidewall of the first elongated frame section;

a ring shelf having a width, the ring shelf removably secured to the first sidewall and the second sidewall of the first elongated frame section, wherein an elongated groove is formed in the ring shelf and extends the across the entire width of the ring shelf, wherein the elongated groove is configured to receive rings therein;

an earring shelf removably secured to the first sidewall and the second sidewall of the first elongated frame section, the earring shelf having a plurality of protrusions extending upwardly therefrom, the protrusions are each configured to receive earrings;

a cylindrical bracelet bar removably secured to the first sidewall and the second sidewall of the first elongated frame section;

a generally arcuate shaped socket secured to the second sidewall of the first elongated frame section, the socket being configured to engage with the cylindrical bracelet bar in order to securely mount the cylindrical bracelet bar to the first elongated frame section;

a first panel removably secured to the first sidewall and the second sidewall of the second elongated frame section;

a locking mechanism having a plurality of slots extending partially through the thickness of the first sidewall of the second elongated frame section; and a tab rigidly secured to the first panel and protruding therefrom, the tab being removably inserted within a corresponding slot of the plurality of slots in order to adjust the height of the panel.

* * * * *